US007000506B1

(12) United States Patent
Steen

(10) Patent No.: US 7,000,506 B1
(45) Date of Patent: Feb. 21, 2006

(54) CABLE CLAMP LOCK NUT WRENCH

(76) Inventor: Mark W. Steen, 18503 Redwood Rd., Castro Valley, CA (US) 94546

( * ) Notice: Subject to any disclaimer, the term of this patent is extended or adjusted under 35 U.S.C. 154(b) by 127 days.

(21) Appl. No.: 10/803,125

(22) Filed: Mar. 16, 2004

Related U.S. Application Data

(60) Provisional application No. 60/550,092, filed on Mar. 4, 2004.

(51) Int. Cl.
*B25B 13/56* (2006.01)

(52) U.S. Cl. ..... 81/125.1; 81/177.7; 81/177.8; 81/177.9; 81/176.15; 81/900

(58) Field of Classification Search ..... 81/119, 81/124.2, 176.2, 177.1, 177.7, 177.9, 125.1, 81/900, 489
See application file for complete search history.

(56) References Cited

U.S. PATENT DOCUMENTS

| | | | | |
|---|---|---|---|---|
| 1,752,074 A | | 3/1930 | Gagne | |
| 2,522,038 A | | 9/1950 | Houghton | 81/90 |
| 3,768,345 A | | 10/1973 | Barnes | 81/90 |
| D304,668 S | * | 11/1989 | Strock | D8/17 |
| 5,477,758 A | * | 12/1995 | Cunningham | 81/177.85 |
| 5,492,040 A | * | 2/1996 | Bellas | 81/125.1 |
| 5,524,511 A | * | 6/1996 | Taka's | 81/176.15 |
| D379,053 S | * | 5/1997 | Howard | D8/21 |
| 6,058,813 A | | 5/2000 | Bryant | 81/176.15 |
| 6,779,424 B1 | * | 8/2004 | Schmidt | 81/176.15 |

* cited by examiner

*Primary Examiner*—Lee D. Wilson
*Assistant Examiner*—Anthony Ojini
(74) *Attorney, Agent, or Firm*—Howard E. Lebowitz

(57) ABSTRACT

The invention relates to a wrench for manipulating lock nuts on cable clamps and conduit for securing electrical cable or conduit to electrical boxes. The wrench is useful for accessing difficult positions in a box such as securing a cable to a corner opening or in a back row of a box having multiple rows of cables. The wrench comprises a central handle shaft, two transition sections, one extending on either side of the handle shaft, and two arc shaped heads, one arc shaped head extending from each transition section, such that each arc shaped head is displaced at an angle to the handle shaft and at a distance normal to the handle shaft. Each head comprises at least two tabs for engaging a lock nut.

15 Claims, 3 Drawing Sheets

CABLE CLAMP LOCK NUT WRENCH

This application claims the benefit of Provisional Application Ser. No. 60/550,092 filed Mar. 4, 2004.

BACKGROUND OF THE INVENTION

1. Field of the Invention

The invention relates to a wrench which is useful for tightening and loosening locknuts on cable clamps or conduits used with electrical boxes.

2. Description of the Prior Art

The problem addressed by this invention is loosening and tightening lock nuts on cable clamps or conduit that are used to secure electrical cables or conduits on entry into and exit from electrical boxes, such as breaker boxes, service entry boxes, and junction boxes. A lock nut (or ring) is an annular ring having a series of protrusions also known as ears around its outer periphery and internal threads that define a circular central opening inside the threads. Lock nuts are used to secure conduit or cable to a "knock out" hole in an electrical box. In the case of securing cable, a cable clamp is used. A cable clamp is a device that slips over an electrical cable having one end section that clamps onto the cable, a second end section that is a cylinder threaded on the outside to accept a lock nut, and a flange between the two end sections. The cable clamp is placed onto the cable, a free end of the cable is fed through one of a number of circular openings located at various positions around the top, bottom, sides and back of the box with the clamping end outside the box and the threaded portion of the cable clamp extending into the box through the circular opening. An installer must access the interior of the box through a generally rectangular panel on the front of the box. The lock nut is threaded onto the threaded portion of the cable clamp until the cable clamp is secured onto the box with the flange on the outside and the lock nut on the inside. The lock nut is then tightened by placing the blade of a screwdriver onto one of the tabs of the lock nut and striking the screw driver with a hammer in a direction which will tighten the lock nut. When conduit is routed into a box, a threaded fitting is attached to the end of the conduit that serves the same purpose as the cable clamp for routing cable. The threaded end is secured with a lock nut inside the box, which is tightened as with the lock nut on cable clamp.

In order to remove the cable or conduit the procedure is reversed. The lock nut is loosened by placing the blade of a screwdriver onto a tab of the lock nut and striking the screwdriver with a hammer in a direction that will loosen the lock nut.

The problem to be solved by the instant invention is tightening and loosening lock nuts, particularly the hammer—screwdriver procedure that is ubiquitous at construction sites. The problem is exacerbated by the fact that electrical boxes often provide very tight quarters in which to work, and there is not always direct access to a particular opening through the front panel. For instance, an opening may be displaced left or right, up or down, and there may be a lip around the panel that must be traversed to reach an opening. There may also be several rows of openings on an edge, and wires may be installed at each position.

Several possible solutions to this problem have been disclosed in the patent literature.

U.S. Pat. No. 1,752,074 to Gagne is a spanner wrench that can be used to tighten or loosen toothed nuts.

U.S. Pat. No. 2,522,038 to Houghton is a wrench designed for use in a junction box, comprising a cage structure attached to a shank with a universal joint, where the cage structure has an annular member with lugs for engaging a nut with teeth.

U.S. Pat. No. 3,768,345 to Barnes is a spanner type drive head having teeth to mate the serrations of a lock nut and having an aperture to accommodate cable.

U.S. Pat. No. 5,524,511 to Takas is a lock nut wrench for conduit comprising a "C" shaped head attached at the center of the "C" to a member which is pivotably attached to a shank of a handle, such that the head extends at an angle from the shaft to provide clearance between the handle and the surface upon which a lock nut is to be tightened. The "C" shaped head is formed to engage the lock nut on a step around its interior surface and provides an opening in the head to fit over a piece of conduit.

U.S. Pat. No. 6,058,813 to Bryant is a lock nut wrench system for applying a proper rotational torque to a lock nut and ability to fit around adjacent wires during tightening and removal. The wrench is of the type with a cylindrical head which fits over a lock nut while having a wire port for passage of wires through the head. The head is pivotably attached to the handle.

U.S. Pat. Nos. 1,752,074, 2,522,038, 3,768,345, 5,524,511, and 6,058,813 referred to above are hereby incorporated herein by reference.

While the above improvements are all potential improvements to tightening and removing lock nuts in electrical boxes, there is still a need for an improved wrench which can be readily used to manipulate lock nuts in positions which are not directly accessible from the front panel opening of the electrical boxes.

There is a particular need for an improved wrench for tightening or removing lock nuts on cable clamps where the wires to be placed or removed are in a corner of an electrical box or behind another wire or group of wires.

There is a need for an improved wrench for tightening or removing lock nuts on cable clamps by accessing the lock not from the side rather than straight ahead or over top.

SUMMARY OF THE INVENTION

It is an object of the invention to provide an improved wrench for tightening and removing lock nuts in electrical boxes, that can be readily used to manipulate lock nuts which are not directly accessible from the front panel opening of the electrical box.

It is a further object of the invention to provide an improved wrench for tightening or removing lock nuts on cable clamps where the cables to be placed or removed are in a corner of an electrical box or behind another wire or group of wires.

It is a still further object of the invention to provide an improved wrench for tightening or removing lock nuts in cable clamps by accessing the nut from the side rather than straight ahead or from above.

One aspect of the invention is a wrench for tightening and loosening lock nuts used to secure cable clamps and conduit to electrical boxes, such as breaker boxes, junction boxes, and the like. The lock nuts are of the type having a series of protrusions on their outer periphery with spaces between the protrusions. Various standard sized cable connectors and conduit are used, each having a particular sized lock nut. Each size of lock nut will have a particular size of wrench adapted to fit the particular standard lock nut.

The wrench is well adapted for loosening and tightening lock nuts on cable clamps at the various positions within electrical boxes. Typically, lock nuts are manipulated through an openable or removable front panel at positions of circular openings in the right, left, top, or bottom edges of the box. In particular it is frequently necessary to reach nuts on cables that are not directly accessible from the front sector of the nut (the 180° sector facing the front panel). This can be the case for a position of an opening in one of the corners of a box, or for manipulating a nut on a cable in a back row of a box containing two or more rows of cables installed. There is also frequently a lip around the front panel that must be navigated. It is also necessary to be able to install the wrench on a nut securing an existing cable that is fixed at both ends, in order to remove the cable.

A preferred embodiment of the instant wrench includes two arc shaped heads, one on either side of a centrally located elongate handle shank. Each arc shaped head extends from a transition section from a point at or near an end of the arc shaped head. Each transition section is displaced from the elongate handle shank by an acute angle as measured from an imaginary line extending the elongate handle shank and by an off set distance normal to the elongate handle shank. Each arc shaped head has at least two tabs extending from the head such that the head fits over a lock nut with each of the tabs between two protrusions on the lock nut. Preferably the two heads are each disposed in an orientation parallel to the handle shank, with the tabs on one head facing in opposite direction to the tabs on the other head. Also, the acute angles are preferably approximately equal magnitude and opposite direction for one side as compared to the other side, and the offset distances are preferably approximately equal in magnitude and opposite in direction for one side as compared to the other.

The wrench differs from prior art arc or C shaped wrenches or span wrenches in that it engages a nut on a side sector of the nut (as opposed to the front sector that faces the front panel) because the arc shaped head extends from an end of the arc rather than the center of the arc or over top of the fitting. For a nut in a corner position, one of the symmetric arc shaped heads will approach a nut from one side, while the other head will approach the other side of the nut when the wrench is flipped over. Also, nuts securing cables in a back row are easily approached from a side rather than straight ahead or from above.

Another aspect of the invention is a method of manipulating a lock nut in an electrical box using the wrench as described previously, comprising the acts of: choosing the more convenient of the two arc shaped heads to reach the position of the lock nut; engaging the more convenient arc shaped head on a sector of the lock nut facing an edge of the electrical box such that the tabs extending from the arc shaped head intermesh with spaces between the protrusions in the lock nut; and turning the wrench to manipulate the lock nut.

BRIEF DESCRIPTION OF THE DRAWINGS

These and other features, aspects and advantages of the present invention will become better understood with regard to the following description, appended claims and accompanying drawings, where:

DESCRIPTION

Figure 1A:
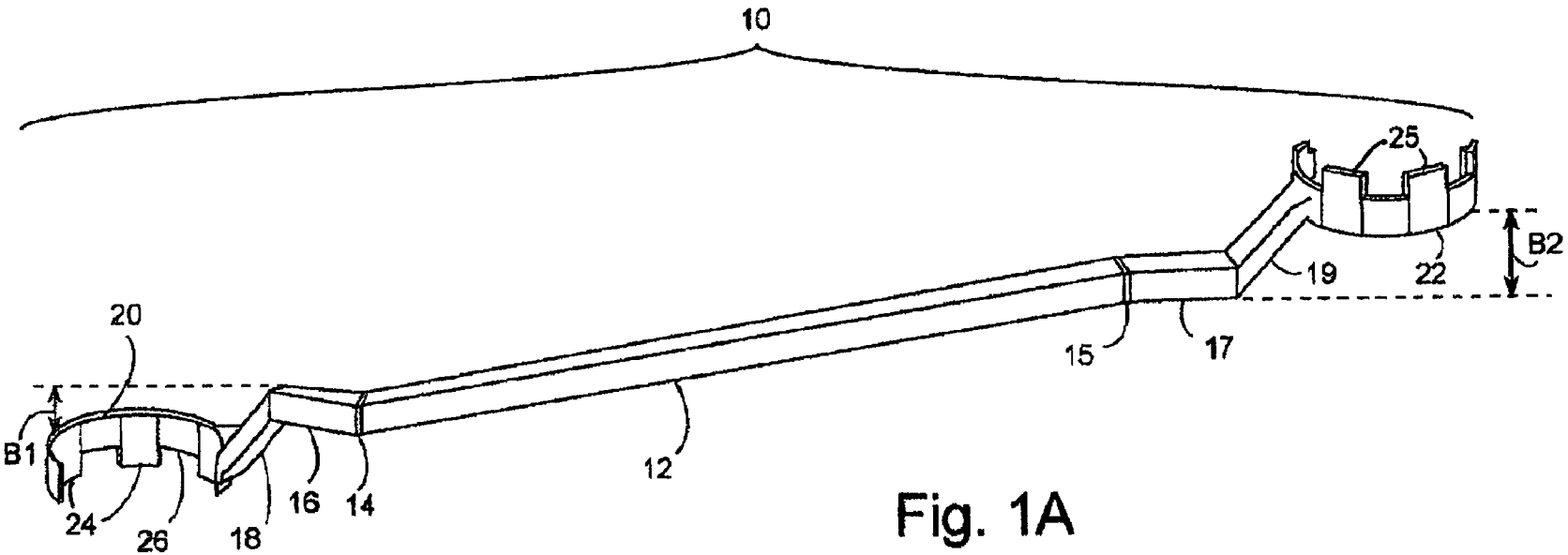
FIG. 1A is a perspective view of a preferred embodiment of the invention.
Figure 1B:
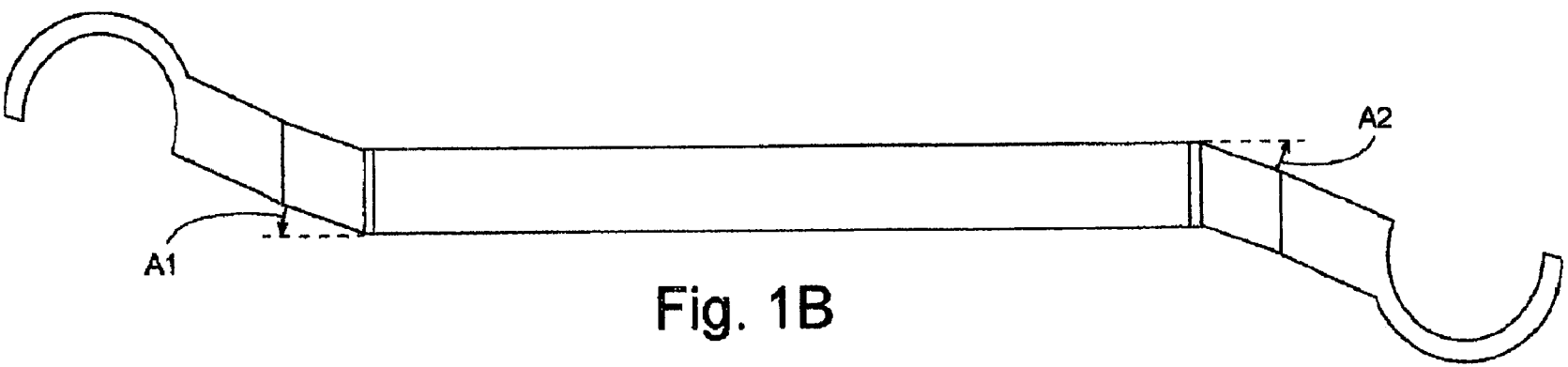
FIG. 1B is a top view of top view of the preferred embodiment.

FIGS. 1A and 1B show a preferred embodiment of the invention, a wrench for tightening and loosening lock nuts used on cable clamps to secure a cable into an electrical box or to secure a conduit to an electrical box. Lock nuts are made in certain standard sizes to fit different sizes of cable clamps such as ½ inch, ¾ inch or 1 inch, which are popular sizes. Lock nuts have a plurality of protrusions around the outside with spaces between them. There are typically either 6 or 8 protrusions depending on the size of the nut.

Referring to FIG. 1A, a first preferred wrench according to the invention comprises an elongate handle shaft section 12 in the center of the wrench, ending at joints 14 and 15 that separate a first side (left) and a second side (right). The handle shaft is preferably straight. A first transition section, including sections 16 and 18 on FIG. 1A, extends from the first side of the handle shaft at an acute angle A1 (shown on FIG. 1B) to the handle shaft as measured from an imaginary line extending the handle shaft on the first side and for an offset distance B1 normal to the handle shaft. A first arc shaped head 20 extends from at or near an end of the arc from the first transition section. The first arc shaped head includes at least two tabs 24 extending from it and a space 26 between tabs. The first arc shape head and tabs thereon are adapted to fit over a particular size of lock nut with the tabs fitting in spaces between protrusions on a lock nut, and is preferably a circular arc, more preferably a semicircle. The opening of the arc shaped head is oriented at acute angle A1 to the handle shaft and is displaced by distance B1 normal to the handle shaft (below it in FIG. 1A). The second (right) side of the wrench beginning at joint 15 comprises a second transition section comprising sections 17 and 19 on FIG. 1A that extend from the second side of the handle shaft at acute angle A2 (shown on FIG. 1B) to the handle shaft as measured from an imaginary line extending the handle shaft on the second side and for an offset distance B2 normal to the handle shaft. A second arc shaped head 22 extends from a point at or near an end of the arc from the second transition section. The second arc shaped head includes at least two tabs 25 extending from it and a space between the at least two tabs. The second arc shaped head and tabs thereon are adapted to fit over a particular size of lock nut with the tabs fitting in spaces between protrusions on a lock nut, and is preferably a circular arc, more preferably semicircular and the same size and shape as first arc shaped head so that it will fit the same lock nut as the first arc shaped head. The opening of the arc shaped head is oriented at acute angle A2 to the handle shaft and is displaced by distance B2 normal to the handle shaft (above it in FIG. 1A).

As shown in FIG. 1A the preferable configuration is for the arc shaped heads 20 and 22 to be parallel to the handle shaft 12, with the tabs 24 and 25 facing in opposite directions preferably perpendicular to the handle shaft. Preferably the acute angles A1 and A2 are of equal magnitude and opposite directions and offset distances B1 and B2 are of equal magnitude and opposite directions.

Figure 2A:
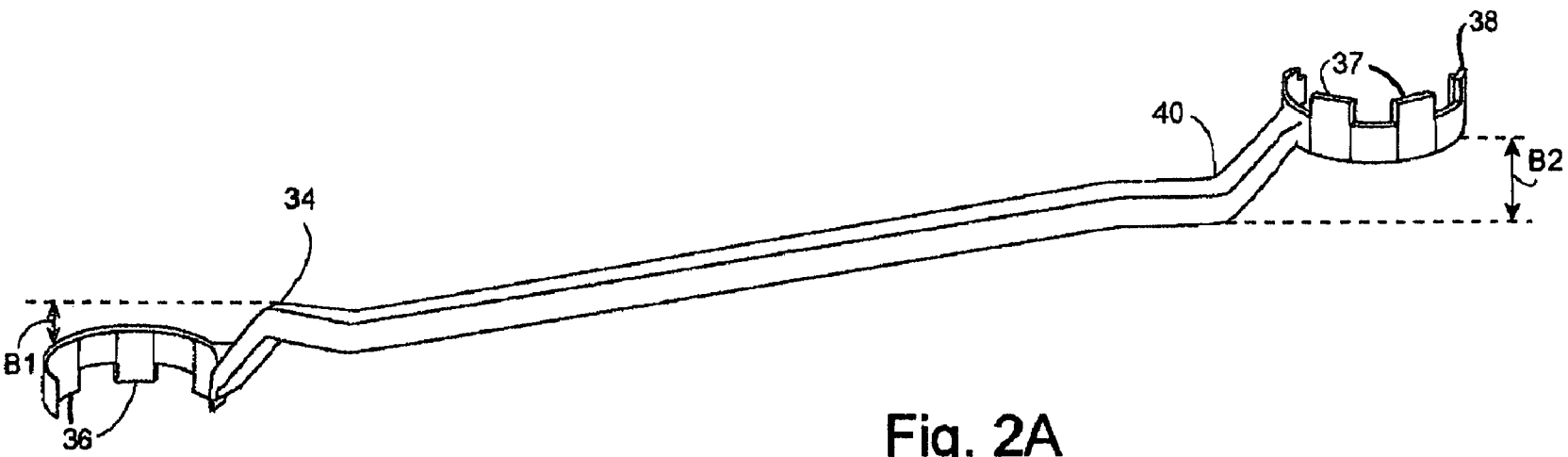
FIG. 2A is a perspective view of an alternative embodiment of the invention.
Figure 2B:
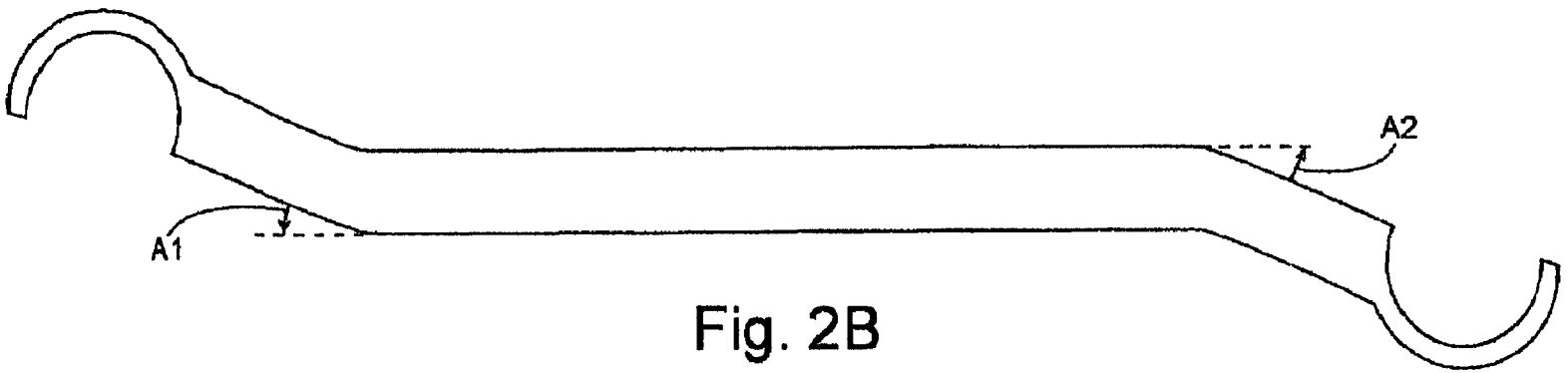
FIG. 2B is a top view of the alternative embodiment.
Figure 3A:
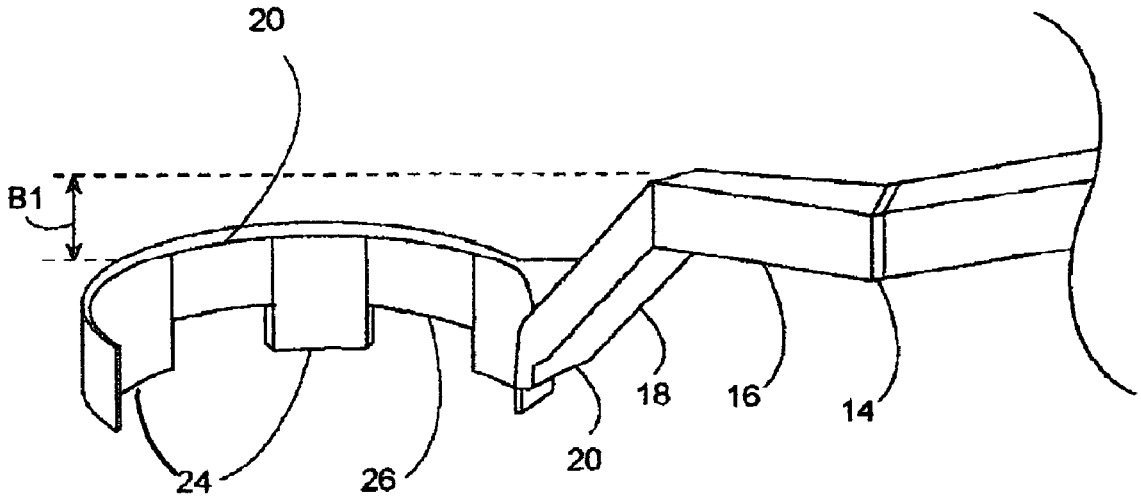
FIG. 3A is a perspective view of one end of the embodiment in FIG. 1A.
Figure 3B:
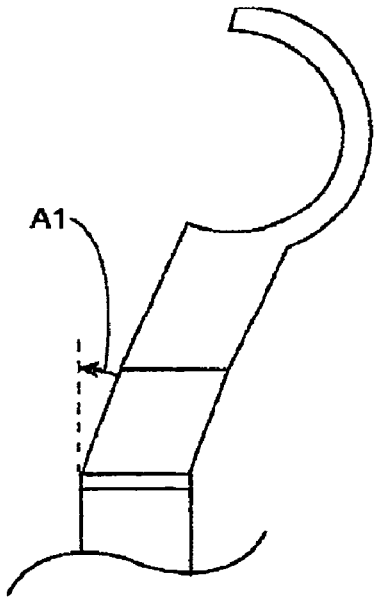
FIG. 3B is a top view of an end of the embodiment in FIG. 1B.

FIGS. 2A and 2B show a slightly different preferred embodiment. In the embodiment shown on FIGS. 1A and 1B, the transition sections are attached to the handle shaft by welding, whereas in FIGS. 2A and 2B, the transition sections 34 and 40 are integral with handle shaft. As in the first embodiment the arc shaped heads are inclined at angles A1 and A2, respectively, to the handle shaft as measured from imaginary lines extending the handle shaft and offset by distances B1 and B2, respectively in a direction normal to the handle shaft. Everything else said about the first wrench applies to this embodiment.

A preferred value of the angles A1 and A2 are in the range of about 15° to about 30° more preferably 20° to 25°. Preferred values for B1 and B2 are in the range of about 0.25 inches to about 1 inch more preferably about ½ inch to about ¾ inch.

There are preferably between 2 and 4 tabs per head. The lock nuts used on cable clamps typically have either 6 or 8 protrusions, so a semicircular arc shaped wrench could have up to 3 or 8 tabs, though it is not necessary to have a tab fit in every space. There should be at least 2 tabs that are sized and spaced to fit into two spaces between protrusions on the desired lock nut.

Wrenches according to the invention are preferably made of steel, and may be made in an integral single piece as by forging, milling or in separate sections welded together. The manufacture is conventional and typical for wrenches and well known to those skilled in the art.

A lock nut wrench according to the invention is used by holding the wrench by the handle shaft portion and placing the wrench through the panel on the front of electrical box with one of the arc shaped heads to one side of the desired lock nut position (a side being a sector of the lock nut facing an edge of the electrical box perpendicular to the front panel) and then moving the arc shaped head so that the tabs on the head engage the spaces between protrusions on the lock nut, and finally rotating the wrench in a direction to tighten or loosen the lock nut.

A lock nut will often be on a cable that is inconvenient to access on one side but more convenient on the other side. Examples are nuts on cables secured in a position near a corner of a box, or cables in a back row of a box (relative to the front panel) where they are behind another cable. In this case one of the two arc shaped heads will be more convenient to use than the other since it will engage an opposing side of the nut. It is preferable to choose the more convenient head before attempting to engage the wrench with the lock nut.

The lock nut wrench is an improved wrench for tightening and removing lock nuts in electrical boxes that can be readily used to manipulate lock nuts which are not directly accessible from the front panel opening of the electrical box. It is convenient to use for securing cables that are in a corner of a box or hidden in a back row. Unlike prior art wrenches it accesses lock nuts from a side rather than straight on or overhead.

Although the present invention has been described in considerable detail with reference to certain preferred versions thereof, other versions are possible. Therefore the spirit and scope of the appended claims should not be limited to the preferred versions herein.

What is claimed is:

1. A wrench for turning lock nuts of the type having a series of protrusions on an outer periphery thereof with spaces between the protrusions, comprising:

a) an elongate handle shaft section having a first side and a second side;

b) a first transition section extending at a first acute angle from the first side of the handle shaft as measured from an imaginary line extending the handle shaft on the first side, and for a first offset distance normal to the handle shaft, and a second transition section extending at a second acute angle from the second side of the handle shaft as measured from an imaginary line extending the handle shaft on the second side and for a second offset distance normal to the second side of the handle shaft;

c) a first arc shaped head extending from the first transition section at a location near an end of the first arc shaped head, and a second arc shaped head extending from the second transition section at a location near an end of the second arc shaped head; and d) at least two tabs extending from the first arc shaped head and at least two tabs extending from the second arc shaped head; wherein each arc shaped head is adapted to fit over a lock nut with each of the at least two tabs thereon fitting in a space between two protrusions on the lock nut.

2. The wrench of claim 1, wherein the two transition sections are integral with the elongate handle shaft.

3. The wrench of claim 1, wherein the two transition sections are each attached to the elongate handle shaft.

4. The wrench of claim 1, wherein the first arc shaped head and the second arc shaped head are each oriented in a direction that is approximately parallel to the elongate handle shaft.

5. The wrench of claim 4, wherein the first angle and the second angle are approximately equal in magnitude and opposite in direction.

6. The wrench of claim 5, wherein the first offset distance and the second offset distance are approximately equal in magnitude and opposite in direction.

7. The wrench of claim 6, wherein the at least two tabs on the first arc shaped head are oriented in a first direction and the at least two tabs on the second arc shaped head are oriented in a second direction opposite to the first direction.

8. The wrench of claim 7, wherein first direction and the second direction are approximately perpendicular to the elongate handle shaft.

9. The wrench of claim 8 wherein the first arc shaped head and the second arc shaped head are in the form of a circular arc.

10. The wrench of claim 8 wherein the arcs are in the form of a semicircle.

11. The wrench of claim 8, wherein the at least two tabs extending from each arc shaped head comprise four tabs extending from each head.

12. The wrench of claim 6, wherein the magnitude of the offset distance is in the range between about 0.25 inch and about 1.0 inches.

13. The wrench of claim 6, wherein the magnitude of the acute angle is in the range between about 15° and about 30°.

14. A method of manipulating a lock nut of the type having a series of protrusions on an outer periphery thereof with spaces between the protrusions, at a position in an electrical box of the type having access to the interior through a front panel, comprising the acts of:

a) using a wrench comprising i) an elongate handle shaft section having a first side and a second side;

ii) a first transition section extending at a first acute angle from the first side of the handle shaft as measured from an imaginary line extending the handle shaft on the first side, and for a first offset distance normal to the handle shaft, and a second transition section extending at a second acute angle from the second side of the handle shaft as measured from an imaginary line extending the handle shaft on the second side and for a second offset distance normal to the second side of the handle shaft;

iii) a first arc shaped head extending from the first transition section at a location near an end of the first arc shaped head, and a second arc shaped head extending from the second transition section at a location near an end of the second arc shaped head; and iv) at least two tabs extending from the first arc shaped head and at least two tabs extending from the second arc shaped head; wherein each arc shaped head is adapted to fit over a lock nut with each of the at least two tabs thereon fitting in a space between two protrusions on the lock nut;

b) choosing the more convenient arc shaped head to reach the position of the lock nut;

c) engaging the more convenient arc shaped head with the lock nut such that the at least two tabs extending therefrom intermesh with spaces between protrusions in the lock nut; and d) turning the wrench to manipulate the lock nut.

15. The method of claim 14, wherein the lock nut is blocked from direct access through the front panel, and the act of engaging further comprises engaging the more convenient arc shaped head on a sector of the lock nut which faces an edge of the electrical box.

* * * * *